US008181888B2

(12) United States Patent
Grace et al.

(10) Patent No.: US 8,181,888 B2
(45) Date of Patent: May 22, 2012

(54) METHOD TO ASSEMBLE WASH LIQUID SPRAY NOZZLES FOR A PULP MAT

(75) Inventors: Todd S. Grace, Alpharetta, GA (US); David Hollis Gordy, Monroe, LA (US); David Brin Tidwell, Monroe, LA (US)

(73) Assignee: Andritz Inc., Glens Falls, NY (US)

( * ) Notice: Subject to any disclaimer, the term of this patent is extended or adjusted under 35 U.S.C. 154(b) by 215 days.

(21) Appl. No.: 12/772,650

(22) Filed: May 3, 2010

(65) Prior Publication Data

US 2010/0205796 A1 Aug. 19, 2010

Related U.S. Application Data

(62) Division of application No. 11/469,968, filed on Sep. 5, 2006, now Pat. No. 7,708,207.

(60) Provisional application No. 60/743,140, filed on Jan. 18, 2006.

(51) Int. Cl.
*B05B 17/00* (2006.01)

(52) U.S. Cl. ..... 239/1; 239/550; 239/556

(58) Field of Classification Search ..... 239/1, 550, 239/553.5, 556, 548, 566, 589, 600, 591, 239/214, 223, 224, 7
See application file for complete search history.

(56) References Cited

U.S. PATENT DOCUMENTS

| | | | |
|---|---|---|---|
| 596,941 | A | 1/1898 | Millspaugh |
| 1,163,734 | A | 12/1915 | Binns |
| 1,396,092 | A | 11/1921 | Binns |
| 2,767,020 | A | 10/1956 | Knowles |
| 3,001,722 | A | 9/1961 | Lawlor et al. |
| 3,351,291 | A | 11/1967 | Pohle |
| 3,369,760 | A | 2/1968 | Schaible |
| 3,859,213 | A | 1/1975 | Hunt |
| 3,878,698 | A | 4/1975 | Friksson et al. |
| 3,966,544 | A | 6/1976 | Johnson |
| 4,121,968 | A | 10/1978 | Wells |
| 4,152,202 | A | 5/1979 | DeLigt |
| 4,217,170 | A | 8/1980 | Luthi |
| 4,236,999 | A | 12/1980 | Burgess et al. |
| 5,965,017 | A | 10/1999 | Nelson et al. |

FOREIGN PATENT DOCUMENTS

CH 167073 4/1934

*Primary Examiner* — Davis Hwu
(74) *Attorney, Agent, or Firm* — Nixon & Vanderhye P.C.

(57) ABSTRACT

A method to assemble a nozzle-fastener assembly including: inserting a hollow stem through a wash liquid direction device; inserting the hollow stem through a mounting block; positioning an inside surface of the mounting block against a curved surface of a wash liquid distribution pipe and an outside surface of the block against the wash liquid direction device; attaching the nozzle-fastener to an aperture in the pipe such that an inlet to the hollow stem is in fluid communication with a wash liquid passage in the pipe, wherein the stem extends through the mounting block and the wash liquid direction device, and the stem includes a outlet for the wash liquid passing through the hollow stem and to the wash liquid direction device, and wherein the wash liquid direction device and mounting block are held together by the attachment of the nozzle-fastener to the aperture in the wash liquid pipe.

20 Claims, 4 Drawing Sheets

METHOD TO ASSEMBLE WASH LIQUID SPRAY NOZZLES FOR A PULP MAT

CROSS RELATED APPLICATIONS

This application is a divisional of application Ser. No. 11/469,968 filed Sep. 5, 2006 and claims the benefit of and priority to Application Ser. No. 60/743,140 filed on Jan. 18, 2006 and which are incorporated herein by reference.

BACKGROUND

The present invention relates to nozzles for a shower pipe to spray wash liquid onto a pulp mat.

Pulp is typically processed in mills by soaking or mixing wood pieces in tanks with chemicals that convert the wood pieces into pulp, and then bleaching pulp. The processing typically involves repeated stages of mixing the pulp with liquid and drawing the liquid out of the pulp by allowing the pulp to form mats on cylindrical vacuum drums. The pulp mats are washed by spraying wash liquid onto the mats. The wash liquid cleans chemicals out of the pulp mat. The wash liquid is sprayed from nozzles attached to liquid pipes spanning the width of the vacuum drums. There is a long felt need for liquid pipes and nozzle assemblies that uniformly spray wash liquid onto the mat and are inexpensive to manufacture and operate.

SUMMARY

A shower pipe and nozzle assembly for spraying a wash liquid on a pulp including: apertures in the pipe extending a length of the pipe spanning a width of the pulp mat, are laterally aligned along two or more rows such that adjacent apertures are in different rows, and the nozzle assembly includes a nozzle, a mounting block and a lip wherein the nozzle includes a hollow stem that attaches to the aperture and secures the nozzle assembly to the pipe, the block has a face that conforms to the pipe surface surrounding the aperture, an opposite face supporting the lip and an opening for the nozzle stem which is offset from a center of the block, and the lip includes a curved fan for turning wash liquid from the nozzle towards the pulp mat, a mounting surface abutting the opposite face of the block and a corner fitting over an edge of the block. The wash liquid flows through the pipe, the hollow stem of the nozzle and out of the nozzle as a stream that is generally tangential to the lip. The fan of the lip gradually turns the water towards the pulp mat and spreads the stream such that the water is sprayed uniformly on the mat. The multiple rows of apertures and nozzles project wash liquid towards the mat at different directions.

A nozzle assembly for spraying a wash liquid onto a pulp mat, the assembly comprising: a nozzle-fastener having an internal conduit for the wash liquid, an external fastener structure for attaching to an aperture in a wash liquid pipe and an outlet to the internal conduit for discharging the wash liquid, and a curved lip having a curved surface mounted to the pipe by the nozzle-fastener extending from the outlet to the internal conduct, the curved surface having an expanding width to convert a stream of wash liquid from the outlet to a sheet of wash liquid directed to the mat. A mounting block may be included in the assembly between the pipe and lip, wherein the block has an offset opening to receive the nozzle-fastener.

DETAILED DESCRIPTION

Figure 1:
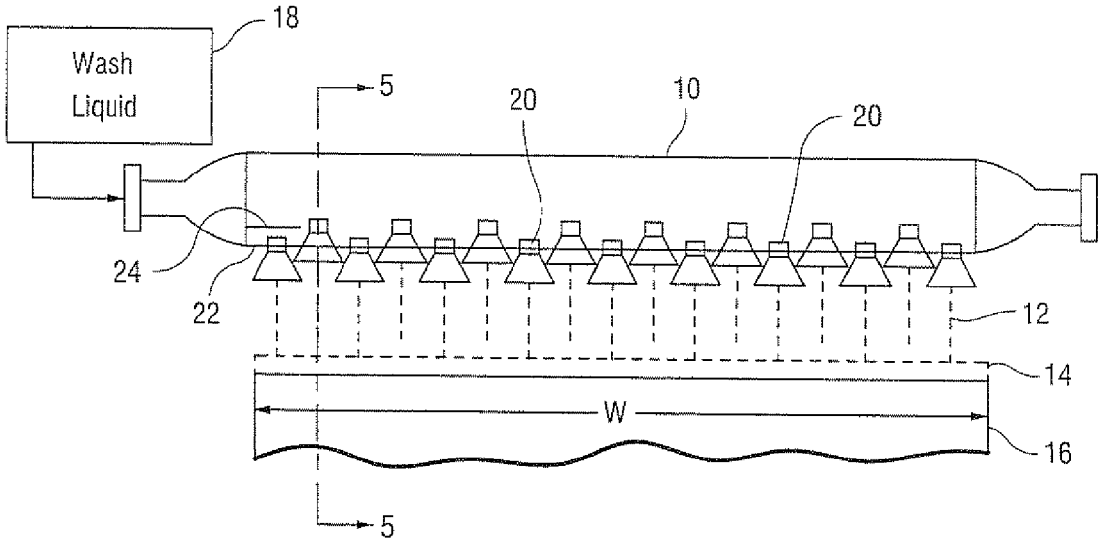
FIG. 1 is a side view of a shower pipe and nozzle assembly, and a section of a pulp mat on a cylindrical dryer.

FIG. 1 shows a shower pipe 10 that sprays a wash liquid 12 onto a pulp mat 14. The mat (shown by dotted lines) forms on a rotating cylindrical vacuum drum 16. The liquid wash is sprayed evenly and uniformly on the mat in one, two or more wash liquid sheets. The shower pipe 10 is positioned near the surface of the mat 14 and drum 16. The shower pipe may be an extended cylinder spanning the width (W) of the vacuum drum. The pipe may be circular in cross-section, but may be rectangular, curvilinear or have some other cross-sectional shape. The pipe is preferably hollow and has an interior closed conduit 26 through which flows the wash liquid. A source 18 of liquid wash is connected to one or both ends of the pipe.

Wash liquid nozzle assemblies 20 are arranged along the length of the pipe 10. The nozzle assemblies may be aligned in one, two or more rows extending laterally along the pipe. In the embodiment shown in FIG. 1, the nozzle assemblies are arranged along a first row 22 and a second row 24. The rows may be angularly offset by an angle (A in FIG. 5) that may be in a range of 3 degrees to 20 degrees. The nozzle assemblies 20 may be arranged to alternate between the rows along the length of the pipe. The nozzle assemblies may be equally spaced along the pipe and the spacing may be determined to provide a relatively uniform spray of wash liquid on the pulp mat 14. The dotted lines in FIG. 1 between the nozzle assemblies and the mat 14 indicate a uniform flow of two sheets of wash liquid being sprayed onto the mat. Preferably, the sprays from two adjacent nozzle assemblies on the same row (and separated by at least one other nozzle assembly on another row) do not overlap.

Figure 2:
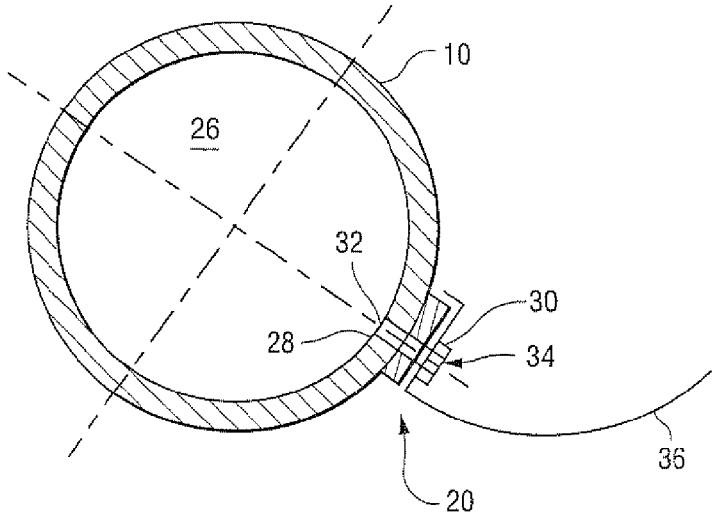
FIG. 2 is a cross-sectional view of the shower pipe and nozzle assembly, showing just one nozzle assembly.

FIG. 2 is a cross-sectional view of the pipe 10 and a single nozzle assembly 20. The interior surface of the pipe defines a wash liquid passage 26. Along each row in the pipe are a series of equally spaced apertures 28 that receive a nozzle-fastener 30 of the nozzle assembly. The apertures 28 may be threaded to receive a threaded stem portion of the nozzle fastener. The apertures 28 may be tapered to ease insertion of the fastener. Wash liquid flows through a hollow passage 32 of the stem of the nozzle-fastener. This hollow passage has an inlet open to the liquid passage 26 and an outlet 34 for projecting wash liquid relatively tangentially to a lip 36 of the nozzle assembly. The nozzle-fastener also secures the nozzle assembly to the pipe, and extends through openings in the lip 36 and in the mounting block 46 (FIG. 4).

Figure 3:
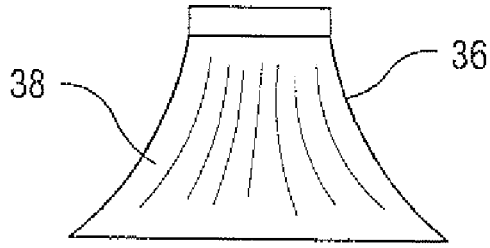
FIG. 3 is a top view of the lip of the nozzle assembly.

As show in FIG. 3, the lip 36 may have a curved surface 38 that has a radially inward section (near the pipe) that is relatively tangent to the circumference of the pipe and perpendicular to the stream of wash liquid flowing from the nozzle. The lip includes a radially outward portion that both curves into the wash liquid stream and expands laterally. The lip may be a generally thin metal or plastic plate having a curved surface 38, a mounting section 48 and a corner 50. The mounting section 48 is a flat planar section that abuts an outside face 51 of the mounting block 46. The corner 50 is a right angled lip that fits over an outside edge 52 of the mounting block. In top view (FIG. 3), the curved surface of the lip is relatively narrow near the nozzle outlet 34 and expands into a fan-like shape. The curved surface 38 of the lip causes the water stream to spread out into a fan shaped liquid spray that flows to the pulp mat.

Figure 4:
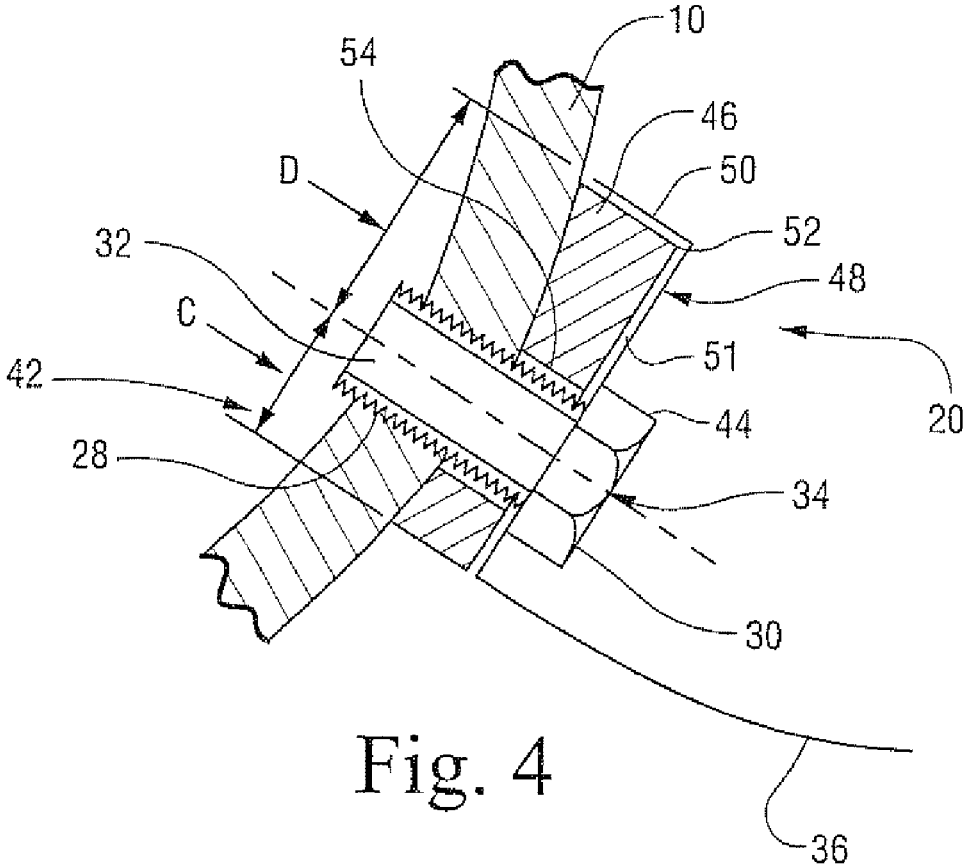
FIG. 4 is an enlarged cross-sectional view of the nozzle assembly showing the hollow nozzle stem attached to an aperture in the pipe, a mounting block for the nozzle assembly, and a portion of the lip of the nozzle assembly.

FIG. 4 is an enlarged view of a nozzle assembly 20 attached to the pipe 10. The nozzle-fastener 30 includes a threaded stem 42 that screws into a threaded aperture 28 in the pipe. The head 44 of the nozzle-fastener may be a hexed bolt head. In one embodiment, the nozzle-fastener is a bolt having a hollow passage 32 that provides a wash fluid conduit from the liquid passage 26 in the pipe to the nozzle outlet 34. The nozzle-fastener secures the nozzle assembly to the pipe.

The nozzle assembly may also include a mounting block 46 that is generally rectangular and has a first side that conforms to and abuts an outer surface of the pipe. The mounting block includes a second side, opposite to the first side, that is generally planar and provides a support surface for a planar mounting section 48 of the lip. An opening 54 through the mounting block receives the stem of the nozzle-fastener, but may not be threaded. The opening 54 in the block may be offset (see difference of lines D and C) from a center of the block. The offset allows the outlet 34 of the nozzle-fastener to be in close proximity to the radially inward portion of the curved surface 38 of the lip 36. The second side of the mounting block abuts against the planar mounting section 48 of the lip 36, when the nozzle-fastener secures the assembly 20 to the pipe. The corner 50 of the lip is a narrow strip that forms a 90-degree corner with respect to the mounting section 48 of the lip. When fitted to the mounting block, the corner 50 folds over an edge 52 of the mounting block and thereby assists preventing the lip from rotating about the mounting block and nozzle-fastener.

Figure 5:
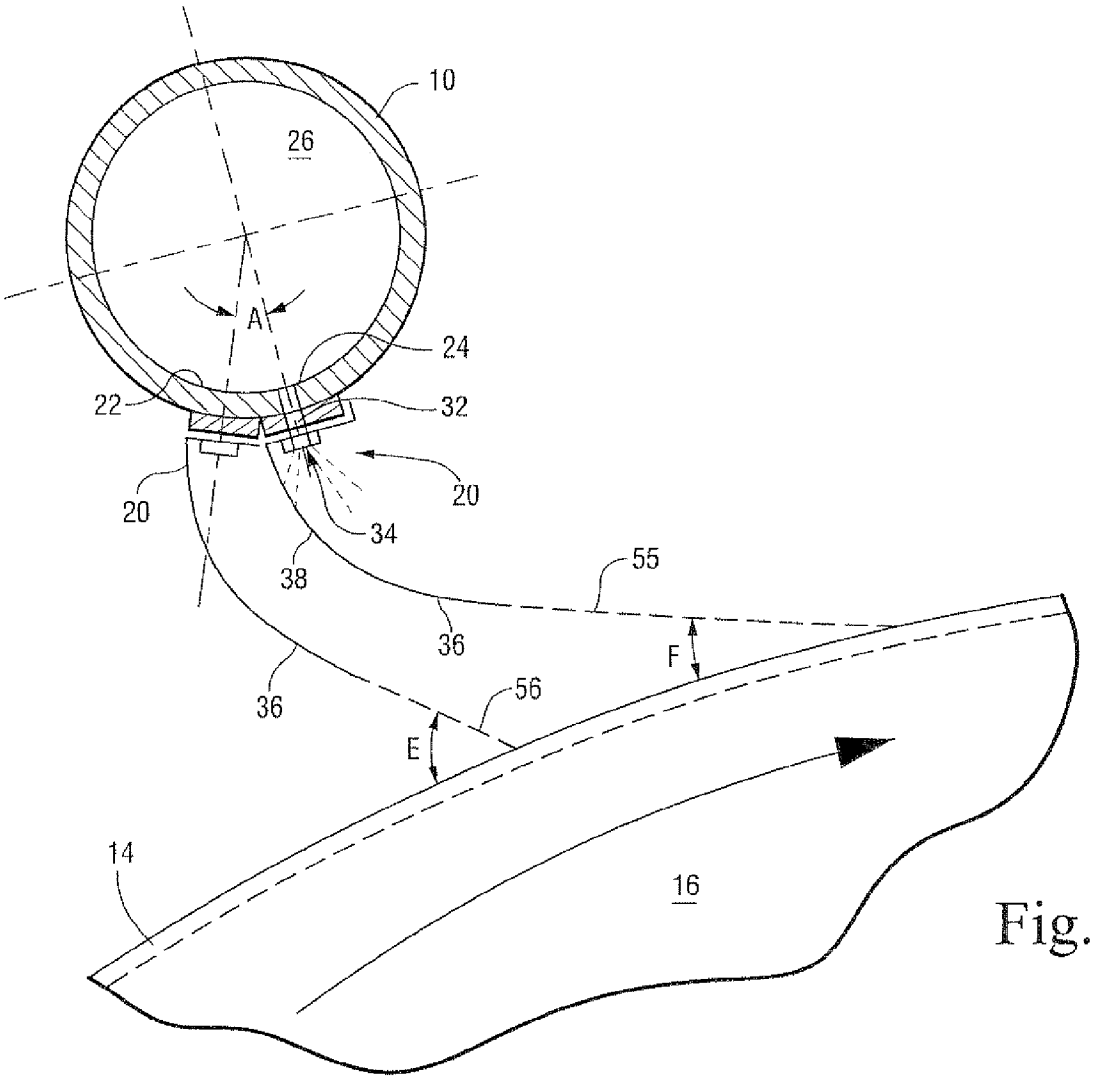
FIG. 5 is a cross-sectional view of the shower pipe and nozzle assembly taken along line 5-5 in FIG. 1 and showing a side view of a portion of the pulp mat and cylindrical dryer.

FIG. 5 shows wash liquid jetting from the outlet 34 of the passage 32 through the nozzle-fastener and flowing onto the curved surface 38 of the lip 36. The lip spreads the water stream and turns the water stream towards a tangent of the pulp mat 14 and cylindrical drum 16. Preferably, the spray of wash liquid from each row 22, 24 of nozzle assemblies is a generally uniform across the width of the mat. The angle (E, F) between the wash spray and mat depends on the row of the nozzle assembly and the amount of curvature in the lip. In the embodiment shown in FIG. 5, two sheets of wash liquid 55, 56 flow onto the pulp mat, where each sheet is from one of the two rows of nozzle assemblies.

Figure 6:
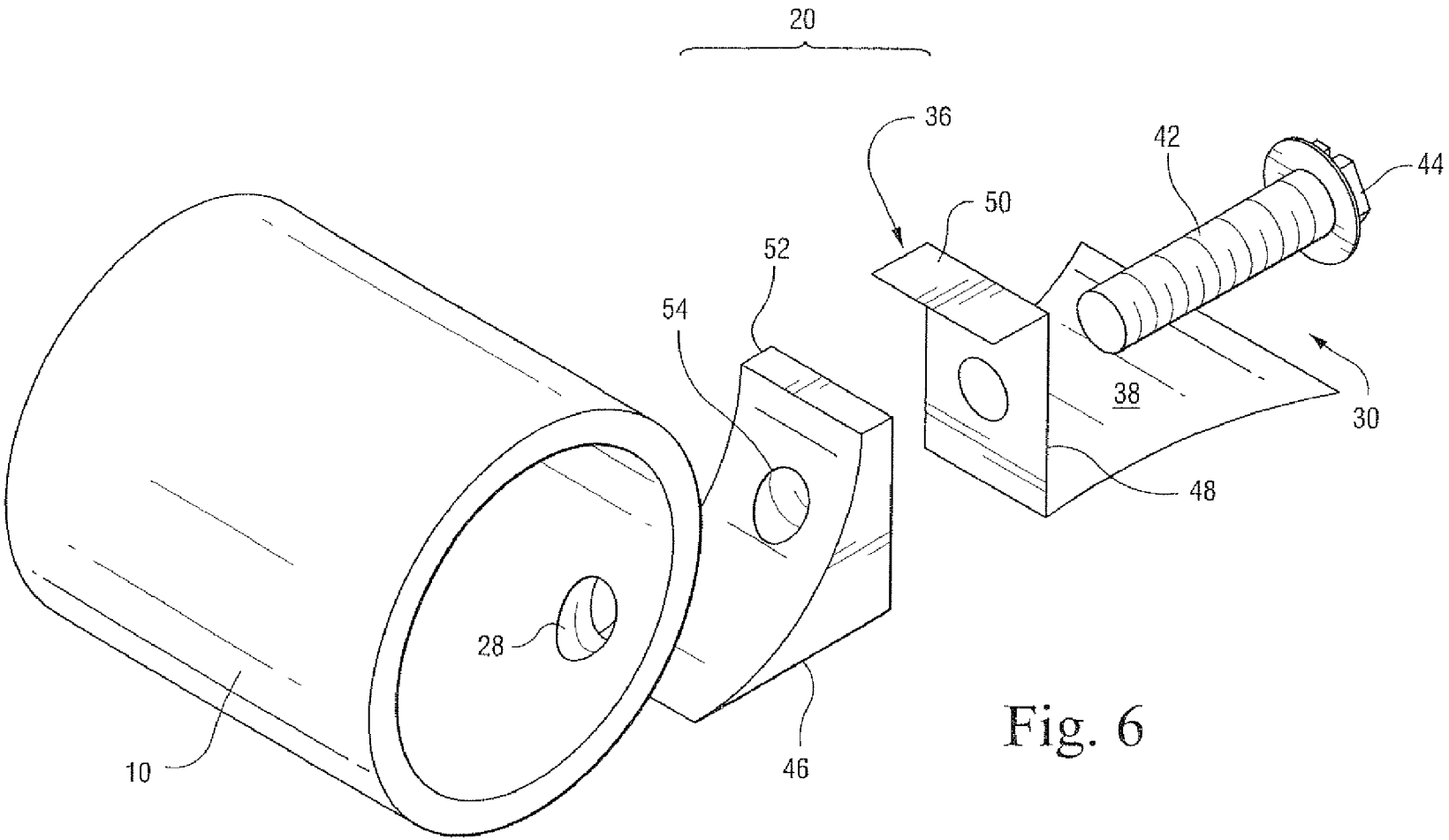
FIG. 6 is an exploded isometric view of the nozzle assembly and a portion of the pipe.

FIG. 6 is an exploded view of the pipe 10 and a nozzle assembly 20. A nozzle-fastener 30 is inserted through an opening in the mounting section 48 of the lip 36 and an opening 54 in the mounting block 46. The stem 42 of the nozzle-fastener screws into a threaded aperture 28 of the pipe to secure the mounting block to the pipe and the lip to the mounting block. The corner 50 of the lip fits around an edge of the mounting block to prevent rotation of the lip.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method to assemble a nozzle-fastener assembly comprising:

inserting a hollow stem of a nozzle-fastener through a wash liquid direction device;

inserting the hollow stem through a mounting block;

positioning an inside surface of the mounting block adjacent a curved surface of a wash liquid pipe and an outside surface of the mounting block adjacent the wash liquid direction device;

attaching the nozzle-fastener to an aperture in the wash liquid pipe such that an inlet to the hollow stem is in fluid communication with a wash liquid passage in the pipe, wherein the stem extends through the mounting block and the wash liquid direction device when attached to the aperture in the wash liquid pipe, and the hollow stem includes an inlet for the wash liquid open to a wash liquid passage in the wash liquid pipe and an outlet for the wash liquid proximate to the wash liquid direction device, and holding together the wash liquid direction device and mounting block against the pipe by the attachment of the nozzle-fastener to the aperture in the wash liquid pipe.

2. A method as in claim 1 further comprising seating a corner of the wash liquid direction device on an edge of the mounting block such that a first portion of the wash liquid direction device abuts a first surface of the mounting block and the a second portion of the wash liquid direction device abuts a second surface of the mounting block, and the corner is between the first surface and the second surface.

3. A method as in claim 1 wherein securing the nozzle-fastener includes engaging threads on an outer surface of the stem with threads on a surface of the aperture in the wash liquid pipe.

4. A method as in claim 1 wherein the wash liquid direction device includes a flat surface with an aperture to receive the stem and a fan surface to direct wash liquid, wherein the attaching of the nozzle-fastener includes seating the flat surface on the mounting block.

5. A method as in claim 1 wherein the nozzle-fastener comprises a head on the hollow stem, wherein the head secures the wash liquid direction device to the nozzle-fastener and the outlet is in the head.

6. The method as in claim 1 wherein an aperture that receives the stem extends through the mounting block and is offset from a center of the mounting block, and a thickness of the mounting block at the aperture is smaller than the thickness at the center of the mounting block.

7. The method as in claim 1 wherein the wash liquid direction device comprises a base portion having a corner and a curved fan-shaped surface extending from the base portion towards a pulp mat adjacent to the wash liquid pipe, and the step of positioning the outside surface of the mounting block against the wash liquid direction device includes seating the corner of the base portion of the wash liquid direction device against a corner of the mounting block, and the method further comprising preventing rotation of the fan-shaped surface with respect to the nozzle-fastener by the seating of the corner of the base against the corner of the mounting block.

8. A method to assemble a nozzle-fastener assembly which sprays a wash liquid towards a pulp mat, the method comprising:

inserting a hollow shaft of a nozzle-fastener through a first portion of a wash liquid dispersion lip having a second portion shaped to disburse the wash water onto the pulp mat;

inserting the hollow shaft of the nozzle-fastener through a mounting support having a first curved surface and a second surface adapted to receive the first portion of the wash liquid dispersion lip, wherein the second surface is opposite to the first surface and the hollow shaft extends through the first curved surface and the second surface;

inserting the hollow shaft of the nozzle-fastener through an aperture in a curved surface of a wash liquid supply pipe, wherein the pipe extends generally parallel to the pulp mat, wherein the hollow shaft includes an inlet extending into the wash liquid supply pipe to receive wash liquid and a wash liquid outlet at an end of the shaft opposite to the inlet;

attaching the nozzle-fastener to an aperture in a wash liquid pipe such that the hollow shaft is in fluid communication with a wash liquid passage in the pipe and the rectangular support and wash liquid dispersion lip are between the pipe and a head of the shaft, and securing the nozzle-fastener to the wash liquid pipe such that the wash liquid dispersion lip and mounting support are held together by the nozzle-fastener.

9. A method as in claim 8 further comprising seating a corner of the wash liquid dispersion lip on an edge of the mounting support such that the first portion of the wash liquid dispersion lip abuts a first surface of the mounting support and the second portion of the wash liquid dispersion lip abuts a second surface of the mounting support, and the corner is between the first surface and the second surface.

10. A method as in claim 8 wherein securing the nozzle-fastener includes tightening threads on an outer surface of the hollow shaft into threads on a surface of the aperture in the wash liquid supply pipe.

11. A method as in claim 8 wherein the first portion of the wash liquid dispersion lip is a flat surface with an aperture to receive the shaft, wherein securing the nozzle-fastener comprises arranging the flat surface to abut the second surface of the mounting support.

12. A method as in claim 8 wherein the mounting support is a rectangular block.

13. A method in claim 8 wherein the nozzle-fastener comprises a head on the hollow shaft, wherein the head secures the wash liquid dispersion lip to the nozzle-fastener and the outlet is in the head.

14. The method as in claim 8 wherein an aperture in the mounting support is offset from a center of the mounting support and a thickness of the mounting support at the aperture is smaller than the thickness at the center of the mounting support.

15. The method in claim 8 wherein the first portion of the wash liquid dispersion lip includes a corner, and the second portion includes a curved fan-shaped surface extending from the outlet of the nozzle-fastener towards the pulp mat and the method further comprises seating the corner of the first portion of the wash liquid dispersion lip against a corner of the mounting support.

16. A method to install a nozzle-fastener assembly on a wash liquid distribution pipe arranged parallel to a cylindrical drum adapted to support a fibrous mat to be washed by wash liquid sprayed from the wash liquid distribution pipe, the method comprising:

inserting a hollow shaft of a nozzle-fastener through an aperture of the wash liquid direction device;

inserting the hollow shaft through an aperture in a mount after inserting the shaft through the wash liquid direction device, wherein the mount has a first curved surface adapted to seat on a curved surface of the distribution pipe and a second planar surface having a corner edge, wherein the second planar surface is opposite to the first curved surface and the aperture in the mount extends through the first curved surface and the second planar surface;

positioning the first curved surface of the mount adjacent the curved surface of the distribution pipe and the second planer surface adjacent of the mount against the wash liquid direction device;

seating a corner of the wash liquid direction device over the corner edge of the second planar surface of the mount;

attaching the shaft of the nozzle-fastener to an aperture in the distribution pipe such that an inlet to the hollow shaft is in fluid communication with a wash liquid passage in the distribution pipe and the hollow shaft includes an outlet proximate to the wash liquid direction device for the wash liquid passing through the hollow shaft, wherein the shaft extends through the mount and the wash liquid direction device.

17. A method as in claim 16 wherein attaching the nozzle-fastener includes tightening threads on an outer surface of the shaft into threads on a surface of the aperture in the pipe.

18. A method as in claim 16 wherein a first portion of the wash liquid dispersion device is a flat surface with the aperture to receive the shaft, wherein the flat surface of the wash liquid dispersion device is positioned to be adjacent the second planar surface of the mount.

19. A method in claim 16 wherein the nozzle-fastener comprises a head on the hollow shaft, wherein the head secures the wash liquid dispersion device to the nozzle-fastener and the outlet is in the head.

20. A method as in claim 16 wherein the aperture in the mount is offset from a center of the mount and a thickness of the mount at the aperture is smaller than the thickness at the center of the mount.

* * * * *